US007152703B2

(12) United States Patent
Meiners et al.

(10) Patent No.: US 7,152,703 B2
(45) Date of Patent: Dec. 26, 2006

(54) COMPACT FOR EARTH BORING BIT WITH ASYMMETRICAL FLANKS AND SHOULDERS

(75) Inventors: Matthew J. Meiners, Spring, TX (US); Raul E. Lema, The Woodlands, TX (US); Jimmy W. Eason, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 247 days.

(21) Appl. No.: 10/855,552

(22) Filed: May 27, 2004

(65) Prior Publication Data

US 2005/0263327 A1 Dec. 1, 2005

(51) Int. Cl.
*E21B 10/52* (2006.01)

(52) U.S. Cl. ..... 175/426; 175/430

(58) Field of Classification Search ..... 175/426, 175/430

See application file for complete search history.

(56) References Cited

U.S. PATENT DOCUMENTS 3,442,342 A * 5/1969 Cunningham et al. ..... 175/374
4,108,260 A * 8/1978 Bozarth ..... 175/374
4,722,405 A 2/1988 Langford, Jr.
5,201,376 A 4/1993 Williams
5,322,138 A * 6/1994 Siracki ..... 175/374
5,379,853 A 1/1995 Lockwood et al.
5,746,280 A * 5/1998 Scott et al. ..... 175/374
5,881,828 A 3/1999 Fischer et al.
5,915,486 A 6/1999 Portwood et al.
6,059,054 A * 5/2000 Portwood et al. ..... 175/430
6,119,798 A 9/2000 Fischer et al.
6,196,340 B1 3/2001 Jensen et al.
6,241,035 B1 6/2001 Portwood
6,332,503 B1 * 12/2001 Pessier et al. ..... 175/336
6,419,034 B1 7/2002 Belnap et al.
6,460,637 B1 * 10/2002 Siracki et al. ..... 175/430
6,484,826 B1 11/2002 Anderson et al.
6,530,441 B1 3/2003 Singh et al.
6,619,411 B1 9/2003 Singh et al.
7,013,999 B1 * 3/2006 Tufts ..... 175/430
2005/0023043 A1 2/2005 Tufts

* cited by examiner

*Primary Examiner*—William P. Neuder
(74) *Attorney, Agent, or Firm*—Bracewell & Giuliani LLP

(57) ABSTRACT

A tungsten carbide compact of an earth boring bit has a cutting tip that is generally chisel-shaped with substantially flat flanks converging to an elongated crest. One of the flanks is smaller and has a greater included angle relative to the axis of the compact than the other flank. Shoulders extend from opposite ends of the crest. One shoulder has a radius of curvature that is smaller than the other shoulder.

21 Claims, 4 Drawing Sheets

COMPACT FOR EARTH BORING BIT WITH ASYMMETRICAL FLANKS AND SHOULDERS

FIELD OF THE INVENTION

This invention relates in general to rolling cone earth boring bits, and in particular to the shapes of carbide compacts used on the cones.

BACKGROUND OF THE INVENTION

A rolling cone earth boring bit has a bit body with typically three legs. A bearing pin depends from each leg. A cone mounts rotatably to the bearing pin. The cone has a plurality of rows of cutting elements. In one type, the cutting elements comprise teeth machined into the surface of the cone. In another type, the cutting elements comprise carbide compacts or inserts that are pressed-fitted into mating holes in the cone surface.

Each compact has a cylindrical base inserted into a hole and a protruding cutting tip. The cutting tips may have chisel, hemispherical, ovoid or other shapes. Particularly on the heel row, which is located near the gage surface of each cone, the compacts may have asymmetrical shoulder surfaces for engaging the sidewall of the bore hole. Depending upon the formation being drilled, different shapes are utilized for aggressiveness of cutting and durability.

Carbide compacts are very hard, but brittle, thus subject to fracturing. Improvements in reducing stress while maintaining the desired aggressiveness particularly in the inner rows are desirable.

SUMMARY OF THE INVENTION

The compact of this invention has a cylindrical base with an asymmetrical cutting tip protruding from the base. The cutting tip has a substantially flat first surface on a first side and a substantially flat second surface on a second side opposite from the first side. The first and second surfaces or flanks join each other at a crest through which the axis of the base extends. When viewed in an axial section plane perpendicular to the crest, an included angle between the first surface and the axis is greater than an included angle between the second surface and the axis.

A convex third surface or shoulder joins the first and second surfaces at one end of the crest, and a convex fourth surface or shoulder joins the first and second surface at an opposite end of the crest. When viewed in an axial section plane parallel to the crest, the third surface has a radius that is greater than a radius of the fourth surface. These compacts are preferably useful in inner rows of the cone.

The compacts may be mounted to the cone in a variety of positions. For example, the compact may be oriented with the first and second surfaces parallel to the direction of rotation. In that instance, the third or larger radius surface, may be the leading surface while the fourth and smaller radius surface becomes the trailing surface, or vice versa. The first surface, which is smaller than the second surface, may locate on the side of the compact closer to the borehole wall, and the second surface closer to the center of the bit, or vice versa. Further, certain rows may vary from other rows. A row or rows in the inward half of the cone may have the larger radius shoulder on one side, and a row or rows in the outer half of the cone may have the larger radius shoulder on the opposite side.

In another embodiment, the compact is oriented with the crest perpendicular to the direction of rotation. In that position, the first surface may become the leading surface, while the second surface becomes the trailing surface. In that orientation, the third surface become the inner side of the compact while the fourth surface becomes the outer side of the compact. Alternately, the first surface could become the trailing surface and the second surface the leading surface. If so, the third surface becomes the outer side of the compact while the fourth surface becomes the inner side.

DETAILED DESCRIPTION OF THE INVENTION

Figure 1:
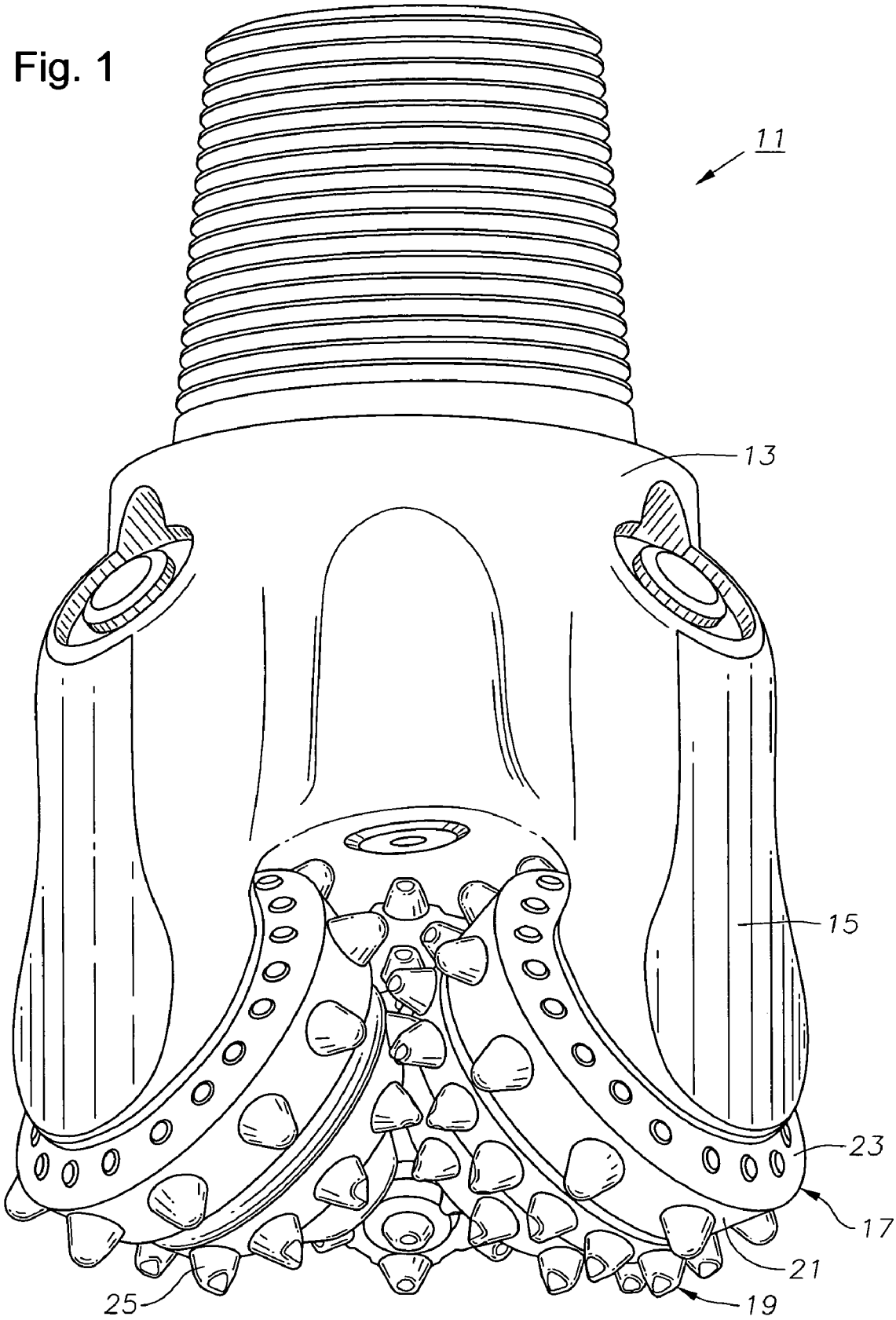
FIG. 1 is a side view of an earth boring bit having compacts constructed in accordance with this invention.

Referring to FIG. 1, bit 11 has a body 13 with at least one leg 15, typically three as shown in this embodiment. A cone 17 rotatably mounts to a bearing pin (not shown) of each leg 15. Each cone 17 has a plurality of inner row compacts or carbide inserts 19, arranged in at least one inner row. A plurality of outer or heel row compacts 21 are adjacent to a gage surface 23 of each cone 17. In the embodiment shown, heel row compacts 21 are generally ovoid, although different shapes could be used.

The preferred shape for at least some of the inner row compacts 19 is generally chisel-shaped, as shown in FIGS. 2–7. Compact 19 has a base 27 that is cylindrical and press-fitted into a mating hole in the surface of cone 17 (FIG. 1). Base 27 has an axis 29 and a bottom 31. Compact 19 is formed of cemented carbide, typically tungsten carbide that is usually homogenous and formed in a die and consolidated by sintering techniques. Optionally, at least one layer of diamond material may be formed on the cutting tip. Also, as another option, portions of the carbide material placed in the die and sintered may be of different grades.

Figure 4:
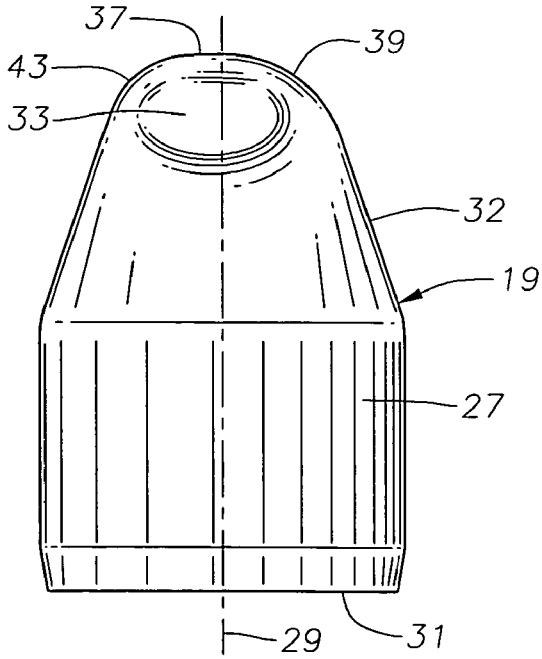
FIG. 4 is an elevational of the compact of FIG. 2, seen from the side opposite the side of FIG. 2, and showing the smaller flank.

The cutting tip has a symmetrical conical surface portion 32 that joins base 27. A first surface 33 (FIGS. 4 and 5) that is flat and forms a flank is located on an upper portion of conical surface portion 32. A second flat surface comprising a flank 35 is formed in conical surface 32 on the opposite side from flank 33. Flanks 33, 35 may be slightly concave or convex. Flank 33 is smaller in surface area than flank 35. Flanks 33, 35 converge towards each other, forming an elongated crest 37 at the apex of conical surface 32. Crest 37 may be straight from one end to the other, or it may be slightly rounded with one or more radii, as shown in FIGS. 2 and 4.

Figure 2:
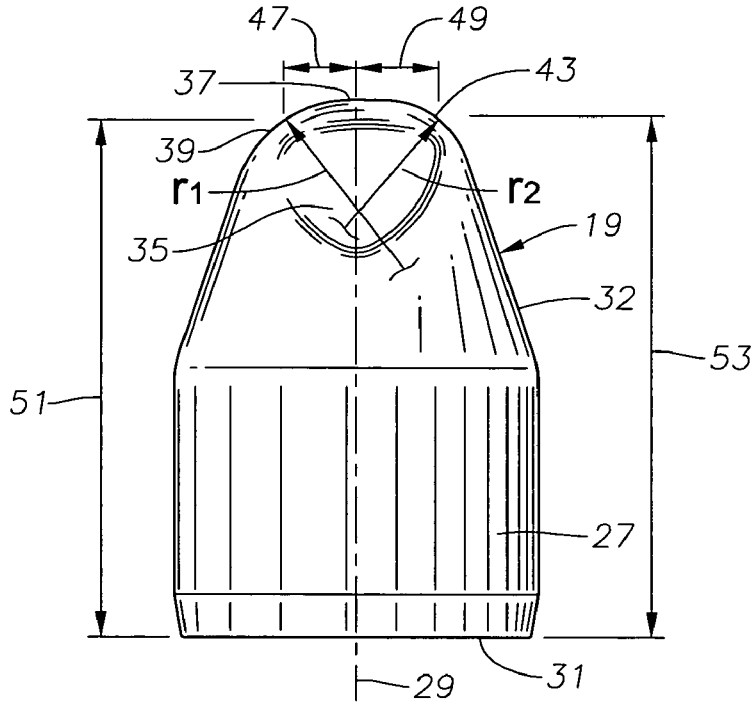
FIG. 2 is an elevational view of one of the inner row compacts of FIG. 1, showing a side that contains the larger flank, with the larger radius shoulder on the left side and the smaller radius shoulder on the right side.

As shown in FIG. 2, a convex rounded shoulder 39 blends a left end of crest 37 to conical surface 32. Shoulder 39 also blends edges of flanks 33, 35 to each other. When viewed in the axial cross-section of FIG. 2, shoulder 39 has a radius r1 that has one end tangent to crest 37 and another end tangent to conical surface 32. Shoulder 39 is also rounded in a plane perpendicular to the cross-section of FIG. 2, as can be seen by the elevational view of FIG. 3. Similarly, a convex rounded shoulder 43 blends the right end of crest 37 with conical surface 32. In the vertical sectional plane of FIG. 2, shoulder 43 has a radius r2 that is smaller than radius r1.

Because of the larger radius r1, shoulder 39 provides a smoother transition from crest 37 to conical surface 32 than shoulder 43. In the axial cross section of FIG. 2, a midpoint of larger radius shoulder 39 between crest 37 and conical surface 32 is at a closer distance 47 to axis 29 than distance 49. Distance 49 is the distance from the midpoint of smaller radius shoulder 43 to axis 29. Also, the midpoint of larger radius shoulder 39 is at a lesser distance 51 to bottom 31 than distance 53. Distance 53 is the distance from bottom 31 to the midpoint of smaller radius shoulder 43.

Figure 3:
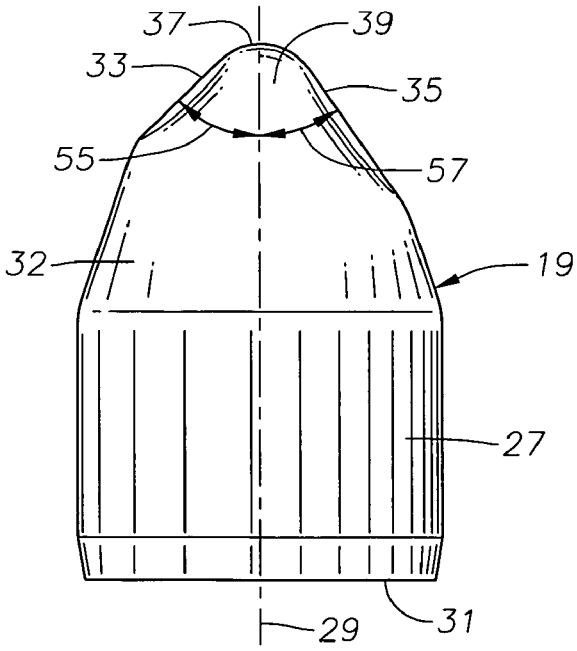
FIG. 3 is an elevational view of the compact of FIG. 2, viewed at 90 degrees to FIG. 1, and showing the larger radius shoulder.
Figure 5:
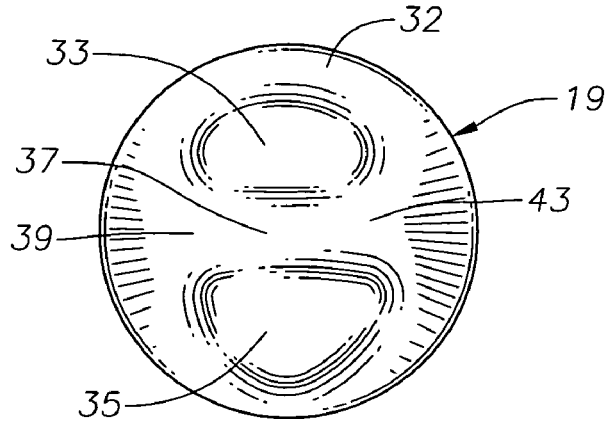
FIG. 5 is a top view of a compact of FIG. 2.

Referring to FIG. 3, smaller flank 33 has an included angle 55 relative to compact axis 29. Included angle 55 is greater than an included angle 57, which is the angle between axis 29 and larger flank 35. Flanks 33, 35 face in opposite directions in the preferred embodiment, but optionally they may be slightly skewed relative to each other. As shown in FIG. 5, crest 37 has a slightly thinner width at its end joining smaller radius shoulder 43 than where it joins larger radius shoulder 39. Because of the different radii of shoulders 39, 43 and the different included angles of flanks 33, 35, compact 19 is asymmetrical in all axial planes, which are planes that contain axis 29.

Figure 6:
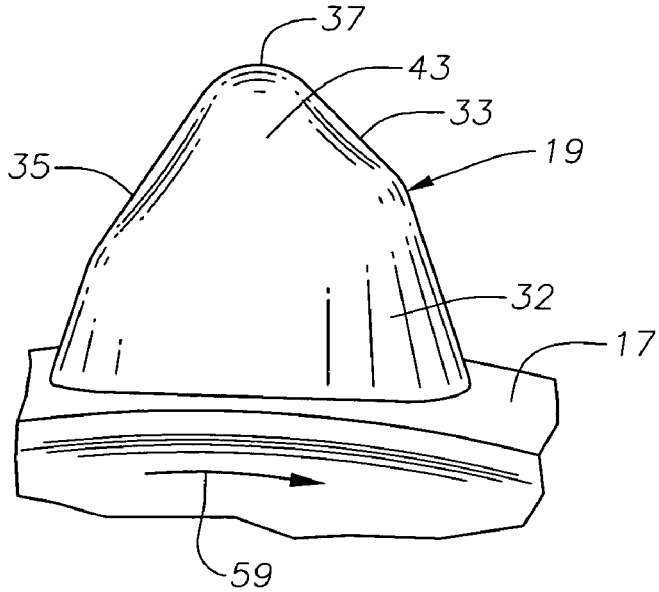
FIG. 6 is a side view of the compact of FIG. 2, shown in a cone and seen from an inner side, with the crest shown perpendicular to the direction of rotation.
Figure 7:
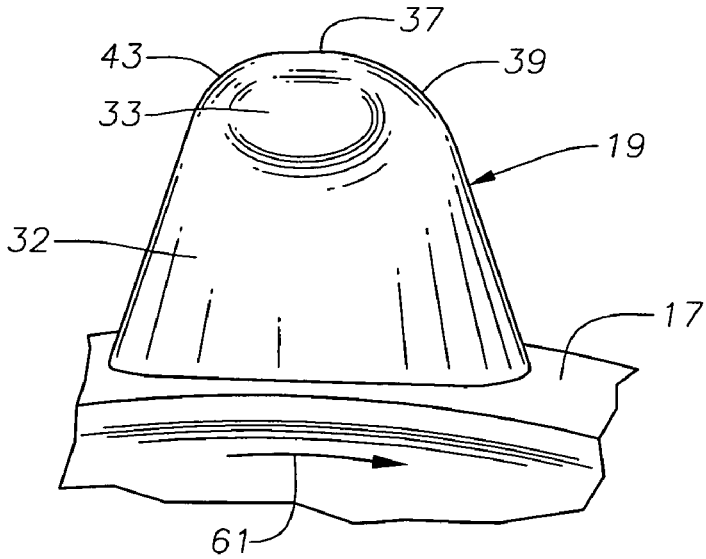
FIG. 7 is a side view of the compact of FIG. 2, shown in a cone and seen from an inner side, with the crest shown parallel to the direction of rotation.

Compacts 19 may be oriented in cones 17 a variety of ways. FIGS. 6 and 7 show two of the ways. In FIG. 6, smaller flank 33 leads and crest 37 is perpendicular to the direction of rotation, shown by arrow 59. Alternately, larger flank 35 could be leading smaller flank 33. In FIG. 7, larger radius shoulder 39 leads and crest 37 is parallel to the direction of rotation, shown by arrow 61. Alternately, smaller radius shoulder 43 could lead larger radius shoulder 39.

Figure 8:
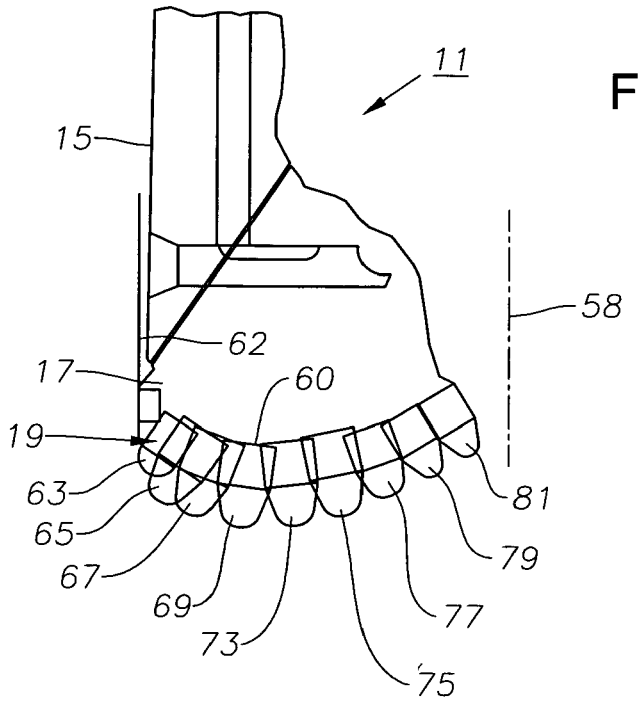
FIG. 8 is a layout of the drill bit of FIG. 1, showing the rows of all three cones superimposed into a single plane.
Figure 9:
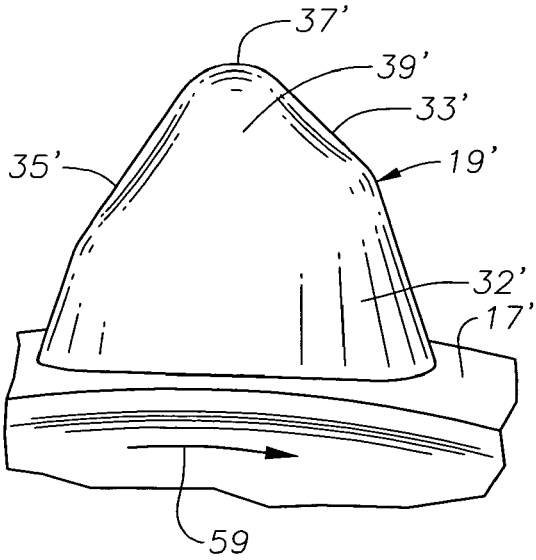
FIG. 9 is a side view of an alternate embodiment compact, shown in a cone and seen from an inner side, with the crest shown perpendicular to the direction of rotation.
Figure 10:
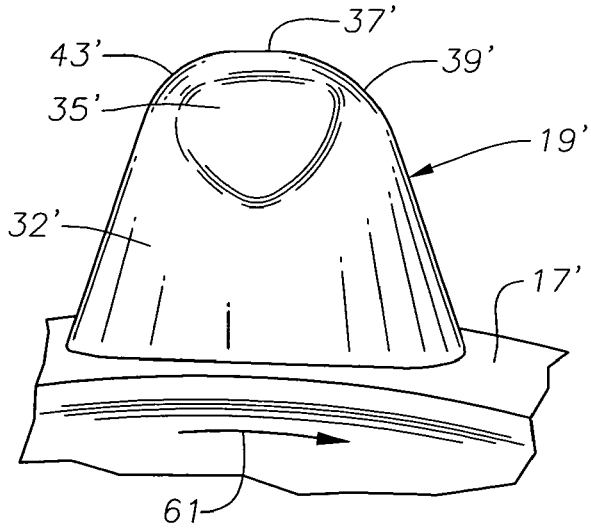
FIG. 10 is a side view of the compact of FIG. 9, shown in a cone and seen from an inner side, with the crest shown parallel to the direction of rotation.

FIGS. 9 and 10 show an alternate embodiment compact 19' with prime symbols used to differentiate it from the first embodiment. Compact 19' is the same as compact 19 of FIGS. 1–8, except for a reversal of shoulders 39, 43 relative to flanks 33, 35. That is, when facing larger flank 35', as shown in FIG. 10, larger radius shoulder 39' will be on the right side rather than the left side, as in FIG. 2.

FIG. 8 is a layout of bit 11, showing all three cones 17 rotated into a single plane. The rows of compacts 19 of the three cones 17 are located at various distances from the bit axis 58 of rotation to provide desired bottom hole coverage and intermesh with each other. The radial direction toward bit axis 58 is considered herein to be inward, and the radial direction away from bit axis 58 toward borehole wall 62 is considered outward. In the example of FIG. 8, there are four rows of compacts 63, 65, 67 and 69 (referred to as outer portion rows) that are farther from bit axis 58 than rows 73, 75, 77, 79 and 81 (referred to an inner portion rows). The compact axis 60 of each compact 19 in outer portion rows 63, 65, 67 and 69, when rotated into the common section plane, inclines downward and outward toward borehole wall 62. On the other hand, in inner portion rows 73, 75, 77, 79 and 81, the compact axis 60 of each compact 19 inclines downward and inward toward bit axis 58. There could be fewer or more inner portion rows 73, 75, 77, 79 and 81 and fewer or more outer portion rows 63, 65, 67 and 69. The difference in inclination of the axes 60 of inner portion row compacts and the outer portion row compacts results in different stresses being applied during drilling.

In one embodiment, some or all of the outer portion rows have compacts 19 as shown in FIGS. 1–7, and the inner portion rows have compacts 19' as shown in FIGS. 9 and 10. Alternately, cones 17 could contain only compacts 19 or only compacts 19' oriented as in FIG. 6 or 9. In FIG. 6, crest 37 is perpendicular to the direction of rotation as indicated by arrow 59. Smaller flank 33 is shown as the leading flank and larger flank 35 as the trailing flank. When oriented as shown in FIG. 6, larger radius shoulder 39 (FIG. 2) is positioned on the outer side, which is the side of compact 19 closer to borehole wall 62 (FIG. 8). In this example, smaller radius shoulder 43 will be located on the inner side, closer to bit axis 58 (FIG. 8). Compact 19 could be oriented in reverse, with larger flank 35 leading smaller flank 33 and larger radius shoulder 39 on the outer side.

A cone 17 with outer portion rows 63, 65, 67 and 69 having compacts 19 oriented as in FIG. 6 optionally may have inner portion rows 73, 75, 77, 79 and 81 with compacts 19' as shown in FIG. 9. Smaller flank 33' is still leading, and larger flank 35' trailing as in FIG. 6. However, unlike FIG. 6, larger radius shoulder 39' is now located on the inner side, closer to the bit axis 58 (FIG. 8). Smaller radius shoulder 43' (shown in FIG. 10) is located on the outer side, closer to borehole wall 62. The orientation of compacts 19' could also be reversed, with larger flank 35' leading and larger radius shoulder 39' being on the outer side. The combination of compacts 19 and 19' is made to accommodate the different inclinations of axes 60 (FIG. 8) between the inner row portion and the outer row portion.

Referring to FIG. 7, compacts 19 of some or all the outer portion rows 63, 65, 67 and 69 (FIG. 8) could be oriented with crests 37 generally parallel to the direction of rotation as indicated by arrow 61. Alternately, cones 17 having all rows containing compacts 19 oriented as in FIG. 7 or compacts 19' oriented as in FIG. 10 could be used. In FIG. 7, larger radius shoulder 39 leads and smaller radius shoulder 43 trails. Larger flank 35 (FIG. 2) locates on the outer side closer to borehole wall 62 (FIG. 8), and smaller flank 33 locates on the inner side closer to bit axis 58 of the bit. This orientation could be reversed with smaller radius shoulder 43 leading and smaller flank 33 being on the outer side.

A cone 17 with outer portion rows 63, 65, 67 and 69 (FIG. 8) having compacts 19 oriented as in FIG. 7 optionally may have inner portion rows 73, 75, 77 and 79 (FIG. 8) with compacts 19' as shown in FIG. 10. Larger radius shoulder 39' is still leading, and smaller radius shoulder 43' trailing as in FIG. 6. Larger flank 35' is now located on the inner side, closer to the bit axis 58 (FIG. 8). Smaller flank 33' (shown in FIG. 9) is located on the outer side, closer to borehole wall 62. The orientation of compacts 19' could also be reversed, with smaller radius shoulder 43' leading and larger flank 35' being on the outer side.

The invention has significant advantages. The generally chisel-shaped compacts of this invention cut more aggressively and more durably in certain formations than conventional chisel-shaped compacts. The different included angles of the flanks and the different radii of the shoulders allow for balance between aggressiveness and durability on a per row basis.

While the invention has been shown in only one of its forms, it should be apparent to those skilled in the art that it is not so limited but is susceptible to various changes without departing from the scope of the invention. The particular included angles and shoulder radii may vary to optimize aggressiveness and durability for the type of formation being drilled.

The invention claimed is:

1. A compact for an earth boring bit, comprising:

a cylindrical base having an axis;

a cutting tip protruding from the base, the cutting tip having a substantially flat first surface on a first side and a substantially flat second surface on a second side opposite from the first side, the first and second surfaces joining each other at a crest through which the axis extends;

the cutting tip having a conical portion symmetrical in all planes about the axis and extending from the base to the first surface;

an included angle between the first surface and the axis being greater than an included angle between the second surface and the axis in an axial section plane perpendicular to the crest;

a convex third surface joining the first and second surfaces at a first end of the crest and a convex fourth surface joining the first and second surfaces at a second end of the crest; and the third surface having a radius that is greater than a radius of the fourth surface in an axial section plane parallel to the crest.

2. The compact according to claim 1, wherein the first surface is smaller in area than the second surface.

3. The compact according to claim 1, wherein a midpoint of the fourth surface is farther from the axis of the compact than a distance from the axis of the compact to a midpoint of the third surface.

4. The compact according to claim 1, wherein the first and second surfaces face generally in opposite directions.

5. The compact according to claim 1, wherein at least a portion of the compact is asymmetrical in all axial planes.

6. A compact for an earth boring bit, comprising:

a cylindrical base having an axis;

a cutting tip protruding from the base, the cutting tip having a substantially flat first surface on a first side and a substantially flat second surface on of the conical portion opposite from the first side, the first and second surfaces joining each other at a crest through which the axis extends;

an included angle between the first surface and the axis being greater than an included angle between the second surface and the axis in an axial section plane perpendicular to the crest;

a convex third surface joining the first and second surfaces at a first end of the crest and a convex fourth surface joining the first and second surfaces at a second end of the crest;

the third surface having a radius that is greater than a radius of the fourth surface in an axial section plane parallel to the crest; and wherein a midpoint of the fourth surface is farther from a bottom of the base than a distance from the bottom of the base to a midpoint of the third surface.

7. An earth boring bit, comprising:

a body having at least one leg;

a cone rotatably mounted to the leg and having a plurality of protruding compacts; at least some of the compacts comprising:

substantially flat first and second flanks facing generally in opposite directions, the first flank being smaller in surface area than the second flank and having an included angle relative to an axis of the compact that is greater than an included angle of the first flank;

first and second shoulders on opposite sides of the compact from each other and extending between edges of the first and second flanks, a midpoint of the second shoulder being farther from the axis of the compact than a midpoint of the first shoulder; and wherein the midpoint of the second shoulder is farther from a bottom of a base of the compact than the midpoint of the first shoulder to the bottom of the base.

8. The bit according to claim 7, wherein the first flank leads the second flank, considering a direction of rotation of the cone.

9. The bit according to claim 7, wherein the second flank leads the first flank, considering a direction of rotation of the cone.

10. The bit according to claim 7, wherein the first shoulder leads the second shoulder, considering a direction of rotation of the cone.

11. The bit according to claim 7, wherein the second shoulder leads the first shoulder, considering a direction of rotation of the cone.

12. The bit according to claim 7, wherein the first shoulder has a larger radius of curvature than the second shoulder in an axial sectional plane.

13. The bit according to claim 7, wherein the second flank faces outward.

14. The bit according to claim 7, wherein the first flank faces outward.

15. The bit according to claim 7, wherein the first shoulder has a larger radius of curvature than the second shoulder in an axial sectional plane and faces outward.

16. The bit according to claim 7, wherein the second shoulder has a smaller radius of curvature than the first shoulder in an axial sectional plane and faces outward.

17. The bit according to claim 7, wherein the compact has a conical surface portion that is symmetrical in all planes about the axis and extends from the base to the first flank.

18. The bit according to claim 7, wherein at least a portion of the compact is asymmetrical in all planes containing the axis of the compact.

19. In an earth boring bit, having a body with at least one bit leg pin and a cone rotatably mounted to the bit leg, the cone having a plurality of rows of compacts, at least some of the compacts comprising:

a cylindrical base having an axis;

a cutting tip extending from the base, the cutting tip having a generally conical surface that is symmetrical in all planes about the axis and extends from the base, the cutting tip having first and second flanks extending from the conical surface and converging to an elongated crest, the second flank being smaller in surface area than the first flank and having an included angle relative to the axis of the compact that is greater than an included angle of the second flank;

a first shoulder extending from a first end of the crest to the conical surface; and a second shoulder extending from a second end of the crest to the conical surface, the first shoulder having a larger radius than a radius of the second shoulder.

20. The bit of claim 19, wherein the first shoulder faces outward in at least one of the rows of compacts and faces inward in at least one of the rows of compacts.

21. The bit of claim 19, wherein the first flank faces outward in at least one of the rows of compacts and faces inward in at least one of the rows of compacts.

* * * * *